United States Patent [19]

Marcum

[11] Patent Number: 4,841,855

[45] Date of Patent: Jun. 27, 1989

[54] DAMPENING UNIT FOR PRINTING PRESS

[76] Inventor: Charles L. Marcum, 5461 Brenner Pass, Fridley, Minn. 55432

[21] Appl. No.: 188,650

[22] Filed: May 2, 1988

Related U.S. Application Data

[63] Continuation of Ser. No. 117,395, Nov. 2, 1987, abandoned, which is a continuatiõn of Ser. No. 919,568, Oct. 20, 1986, abandoned, which is a continuation of Ser. No. 660,008, Oct. 11, 1984, abandoned.

[51] Int. Cl.[4] ..... B41F 7/40

[52] U.S. Cl. ..... 101/148; 101/352

[58] Field of Search ..... 101/148, 147, 207, 208, 101/209, 210, 351, 352, 350, 349

[56] References Cited

U.S. PATENT DOCUMENTS

| | | | |
|---|---|---|---|
| 2,231,694 | 2/1941 | Stevens . | |
| 2,233,210 | 2/1941 | Huck . | |
| 2,320,523 | 6/1943 | Jirousek . | |
| 2,570,242 | 10/1951 | James . | |
| 2,972,944 | 2/1961 | Dahlaren . | |
| 3,168,037 | 2/1965 | Dahlgren . | |
| 3,205,816 | 9/1965 | Heimcicher | 101/366 |
| 3,259,062 | 7/1966 | Dahlaren . | |
| 3,285,169 | 11/1966 | Hartwig | 101/364 X |
| 3,343,484 | 9/1967 | Dahlgren . | |
| 3,352,317 | 11/1967 | Dahlgren . | |
| 3,411,442 | 11/1968 | Muhlich . | |
| 3,504,626 | 4/1970 | Worthington | 101/148 |
| 3,507,215 | 4/1970 | Schuhmann . | |
| 3,508,489 | 4/1970 | Norton | 101/148 |
| 3,603,254 | 9/1971 | Siebke | 101/148 |
| 3,647,525 | 3/1972 | Dahlaren . | |
| 3,705,451 | 12/1972 | Rahlcren | 101/148 |
| 3,744,414 | 7/1973 | Krochert | 101/148 |
| 3,757,689 | 3/1973 | Koch et al. | 101/148 |
| 3,842,735 | 10/1974 | Southam | 101/148 |
| 3,911,815 | 10/1975 | Banfer | 101/148 |
| 3,937,141 | 2/1976 | Dahlgren . | |
| 3,949,668 | 4/1976 | Smith, Jr. | 101/366 |
| 3,986,452 | 10/1976 | Dahlgren . | |
| 4,064,801 | 12/1977 | Switall | 101/147 |
| 4,130,057 | 12/1978 | List | 101/148 |
| 4,233,898 | 11/1980 | Dahlgren . | |
| 4,290,359 | 4/1981 | Kapoor | 101/350 |
| 4,351,236 | 9/1982 | Beisel | 101/148 |
| 4,365,552 | 12/1982 | Kubert . | |
| 4,385,559 | 5/1983 | Jarach . | |
| 4,440,081 | 4/1984 | Beisel | 101/148 |
| 4,481,882 | 11/1984 | Rudolph | 101/148 |
| 4,567,823 | 2/1986 | Hummel et al. | 101/148 |

*Primary Examiner*—J. Reed Fisher

*Attorney, Agent, or Firm*—Merchant, Gould, Smith, Edell, Welter & Schmidt

[57] ABSTRACT

Apparatus is disclosed for dampening a lithographic plate on a printing press cylinder, which includes a fluid supply roller and a metering roller that are disposed in rotatable engagement and carried by a pivotally mounted first hanger. A dampening form roller is carried by a second hanger that is pivotally mounted to the first hanger, permitting the form roller to move into and out of engagement with the fluid supply roller and with the press cylinder. The metering roller and form roller are driven at a rotational speed different than that of the fluid supply roller. A water supply pipe includes nozzles for supplying dampening fluid to the fluid supply roller over its length. An actuator is operably connected to move the form roller first into engagement with the fluid supply roller, from which it receives a metered amount of dampening fluid, and then into engagement with the plate cylinder, to which it transfers the dampening fluid.

22 Claims, 6 Drawing Sheets

11
65
66
67
64
72
74
73
32a
63a
81
75
37
32b
36
82
21
63
53
32a
61
54
51
52
31
62a
32
23a
24a
36a
38
62
55
56
68a
35
34
28
33
68
68b
71
13
12

DAMPENING UNIT FOR PRINTING PRESS

This is a continuation, of application Ser. No. 117,395, filed Nov. 2, 1987, now abandoned which is a continuation of Ser. No. 919,568, filed Oct. 20, 1986, now abandoned which is a continuation of Ser. No. 660,008, filed Oct. 11, 1984, now abandoned.

The invention broadly relates to printing presses and is specifically directed to an improved apparatus for applying dampening fluid to a lithographic printing plate.

Lithographic plates used in offset printing are constructed in such a way that one portion of the lithographic plate (e.g., the portion which is to produce the desired image) is made attractive to ink, while the remaining portion is made ink repellent. A dampening fluid such as water, with or without additives such as alcohol, is applied to the lithographic plate to dampen its nonprinting areas and assist in repelling ink. The application of dampening fluid to the lithographic plate must be precisely controlled to produce optimum results, since excessive or insufficient dampening fluid results in inferior printing.

U.S. Pat. No. 3,163,037, which issued to Harold P. Dahlgren on Feb. 2, 1965, discloses an apparatus for dampening lithographic offset printing plates in which physical contact between the lithographic plate and the dampening source is avoided. This permits the dampening fluid to be applied uniformly to the inked lithographic plate without transfer of the ink back to the dampening mechanism. The system utilizes a fluid supply roller which has a metallic, smoothly polished outer surface and is chemically treated to make it water attractive (hydrophilic). This hydrophilic roller rotatably engages one of the ink form rollers of the press in a manner so that the film of dampening fluid on the hydrophilic roller is split, with a portion picked up by the layer of ink on the ink form roller and transferred to the lithographic plate. The other portion of the dampening fluid is retained on the hydrophilic roller to repel ink, preventing the transfer of ink back into the dampening system.

The subject invention is an improvement of the dampening apparatus disclosed in U.S. Pat. No. 3,168,037, and provides a number of structural and functional improvements and features that significantly enhance the dampening operation and thereby improve the quality of printing.

The inventive dampening apparatus utilizes a hydrophilic fluid supply roller that is direct driven by a variable speed motor, and which acts as a pivot point for movement of other rollers in the system. The preferred embodiment utilizes a metering roller that is driven by the hydrophilic roller at a slightly greater rotational speed, but which is in continuous engagement with the hydrophilic roller so that relative slippage or wiping takes place. This results in maintaining a precisely controlled uniform layer or film of water on the hydrophilic roller.

The metering roller is carried in a main hanger frame that pivots about the rotational axis of the hydrophilic roller, permitting the metering roller to move through a limited range of arcuate movement while maintaining driving and roller engagement with the hydrophilic roller.

A dampening form roller is disposed for selective engagement with the hydrophilic roller and lithographic plate cylinder. This is accomplished by mounting the form roller eccentrically on a form roller hanger which is pivotally connected to the main hanger frame. The pivotal connection of the form roller hanger is spaced from the rotational axis of the form roller so that pivotal swinging movement of the form roller hanger effects limited arcuate movement of the form roller between positions of nonengagement and engagement with the hydrophilic roller. An adjustable limit stop precisely determines the engagement between these two rolls.

An actuator taking the form of a pneumatic cylinder, lever arms and toggle mechanism operates to first move the roller hanger frame to cause engagement of the form roller with the hydrophilic roller. The actuator thereafter causes movement of the main hanger frame to move the form roller into engagement with the lithographic plate cylinder. This engagement is also precisely controlled by an adjustable stop.

A bridge roller is disposed in continuous engagement between an ink roller and the dampening form roller to continuously apply a layer of ink to the form roller. The form roller is rotatably driven by the bridge roller and by the lithographic plate cylinder upon engagement at a speed which is less than the selected rotational speed of the hydrophilic roller.

As constructed, the form roller does not engage either the hydrophilic roller or the lithographic plate cylinder when the printing press is inoperative. Operation of the actuator initially causes the form roller to engage the hydrophilic roller, and the relative rotational velocities result in the "milling" of a precisely controlled layer or film of water onto the form roller. It will be recalled that the layer or film of water on the hydrophilic roller is split, with a portion being retained to repel ink and thus prevent ink from entering the dampening fluid supply.

Further actuation of the actuator causes the form roller to engage the lithographic plate cylinder to apply the precisely controlled water film to the lithographic plate. The water is retained by the nonprinting areas, resulting in optimum printing results.

Causing all motions of the dampening apparatus to be concentric around the fixed hydrophilic roller permits the various rollers to be adjusted much more easily, and at the same time adjustment of one roller will not affect the settings of other rollers. Driving the hydrophilic roller on a fixed rotational axis with a variable speed motor avoids the setting of gears, which is common in prior art structures.

Another significant improvement with the inventive dampening apparatus is the requirement of a single adjustment to set the form roller to the hydrophilic roller in a precise manner, and a single adjustment for setting the form roller to the lithographic plate cylinder in a precise manner.

The toggle mechanism used in the actuator moves to an over center position when the system is operative, thus avoiding problems resulting from fluctuations in air pressure supplied to the pneumatic actuator.

In addition, the bridge roller in the preferred embodiment is mounted by eccentric bushings to insure a proper setting of the bridge roller to the form roller, whether the form roller is in the operative or inoperative position.

Last, water is applied to the hydrophilic roller through a plurality of water jets, rather than the conventional approach of running the roller in a pan of water. This insures that all lint and other debris which might be lifted from the pan is flushed off the hydrophilic roller before such debris can enter the press.

DESCRIPTION OF THE PREFERRED EMBODIMENT

Figure 1:
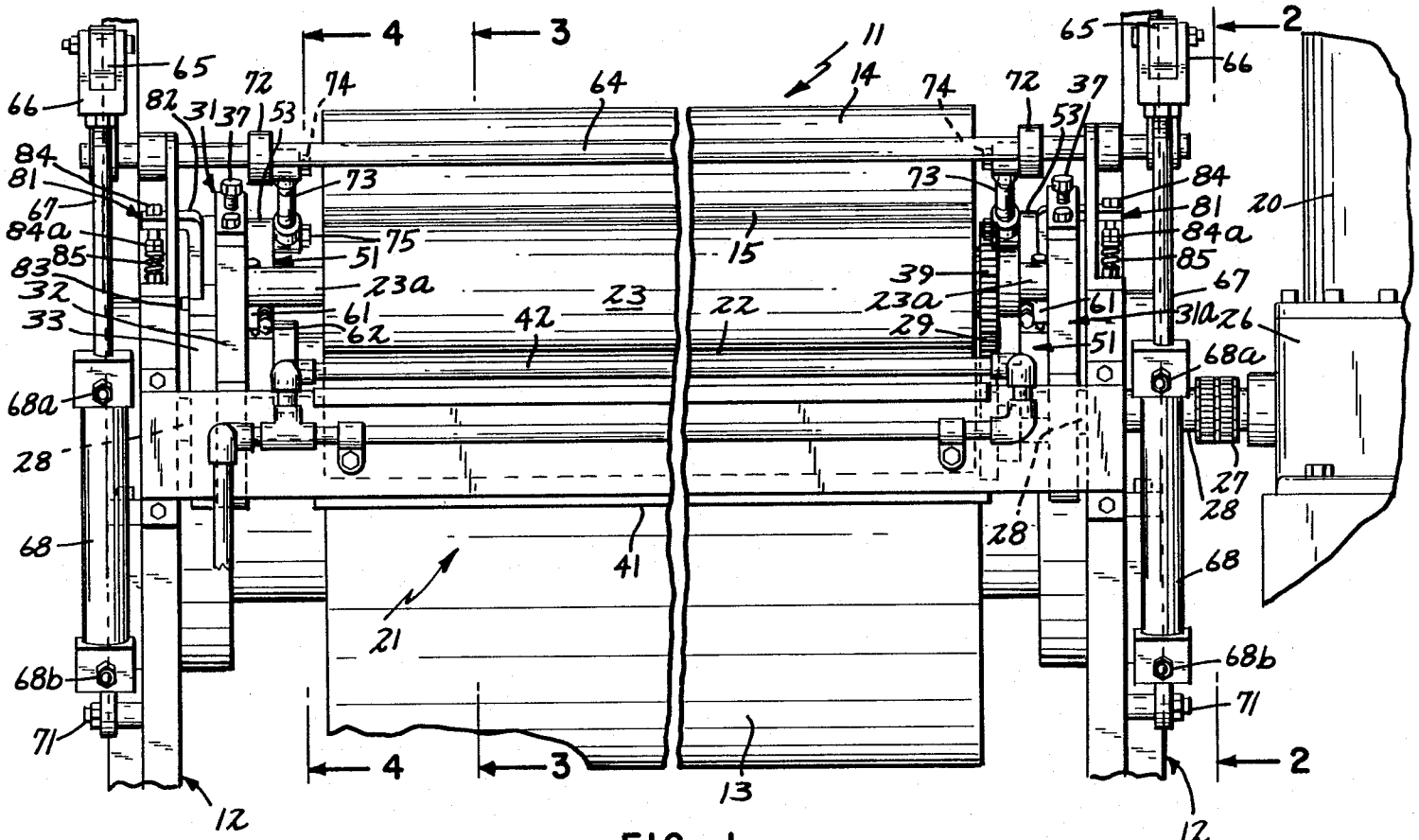
FIG. 1 is a view in end elevation of dampening apparatus for a printing press which embodies the invention.

With initial reference to FIGS. 1–4, a printing press utilizing the inventive dampening apparatus is represented generally by the numeral 11.

Printing press 11 comprises a frame 12 formed from a number of separate components all of which bear the reference numeral 12. A large plate cylinder 13 is mounted to the frame 12 for rotation about a horizontal axis, and is adapted to receive a lithographic plate (not shown). Ink is fed to the lithographic plate on cylinder 13 through a series of rollers 14–16 that are also rotatably mounted to the frame. The rollers 14–16 are in rotatable engagement with each other and the plate cylinder 13 to distribute ink which is fed from a conventional supply source (not shown) onto the lithographic plate as the plate cylinder 13 is rotated.

Figure 2:
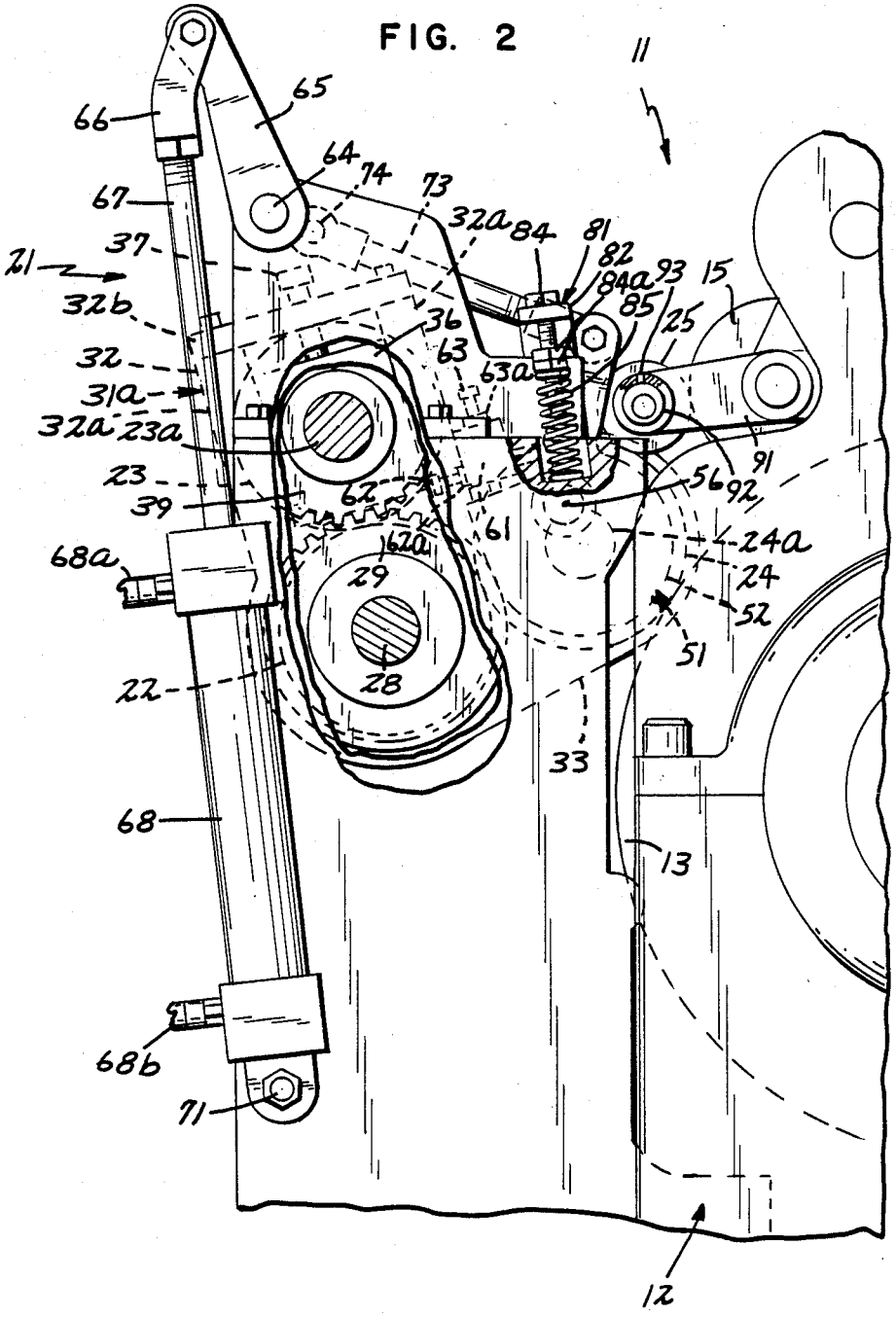
FIG. 2 is an enlarged fragmentary sectional view taken along the line 2—2 of FIG. 1 showing the apparatus in a first mode of operation.
Figure 3:
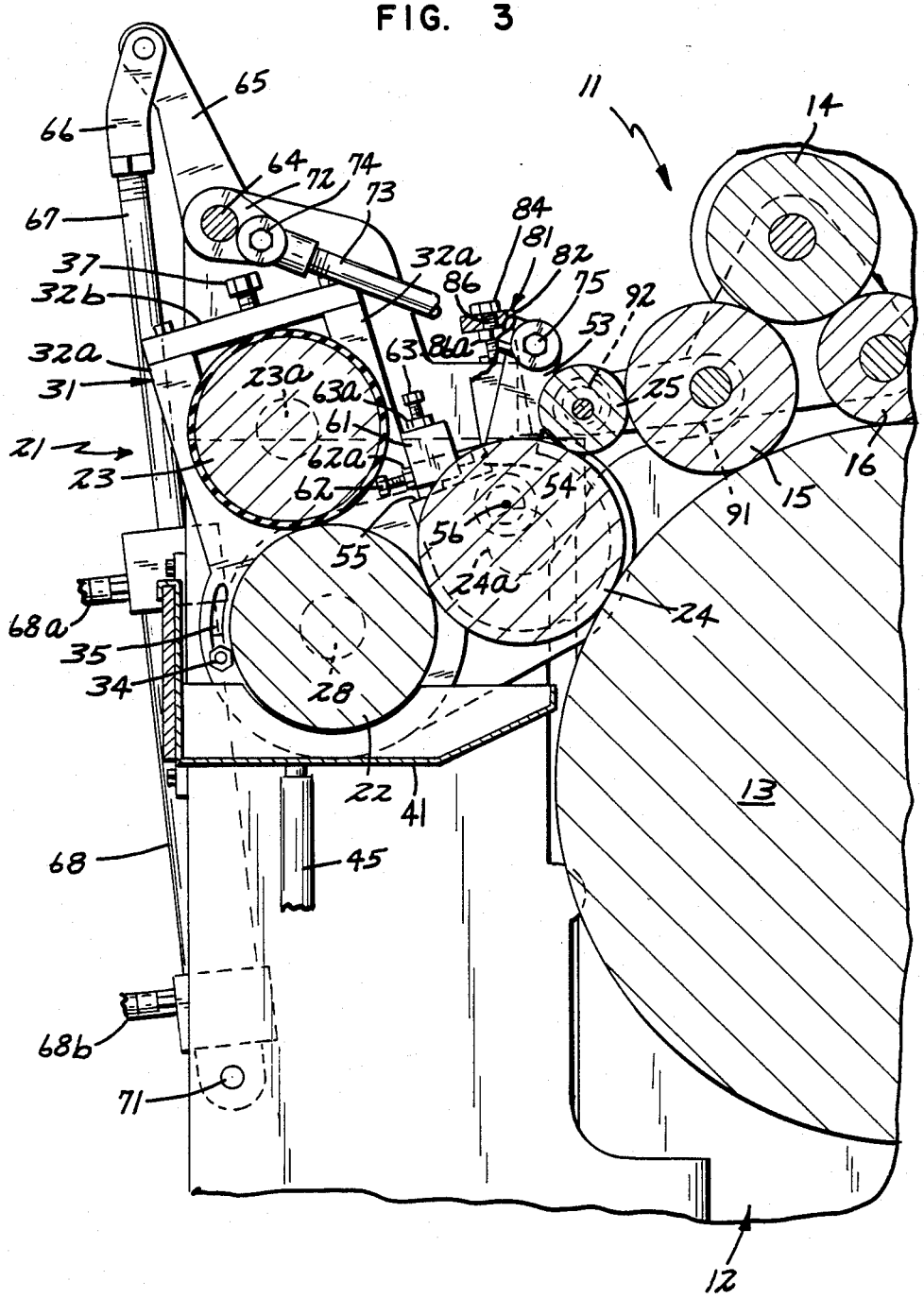
FIG. 3 is an enlarged fragmentary sectional view taken along the line 3—3 of FIG. 1 with the apparatus in the first mode of operation.
Figure 4:
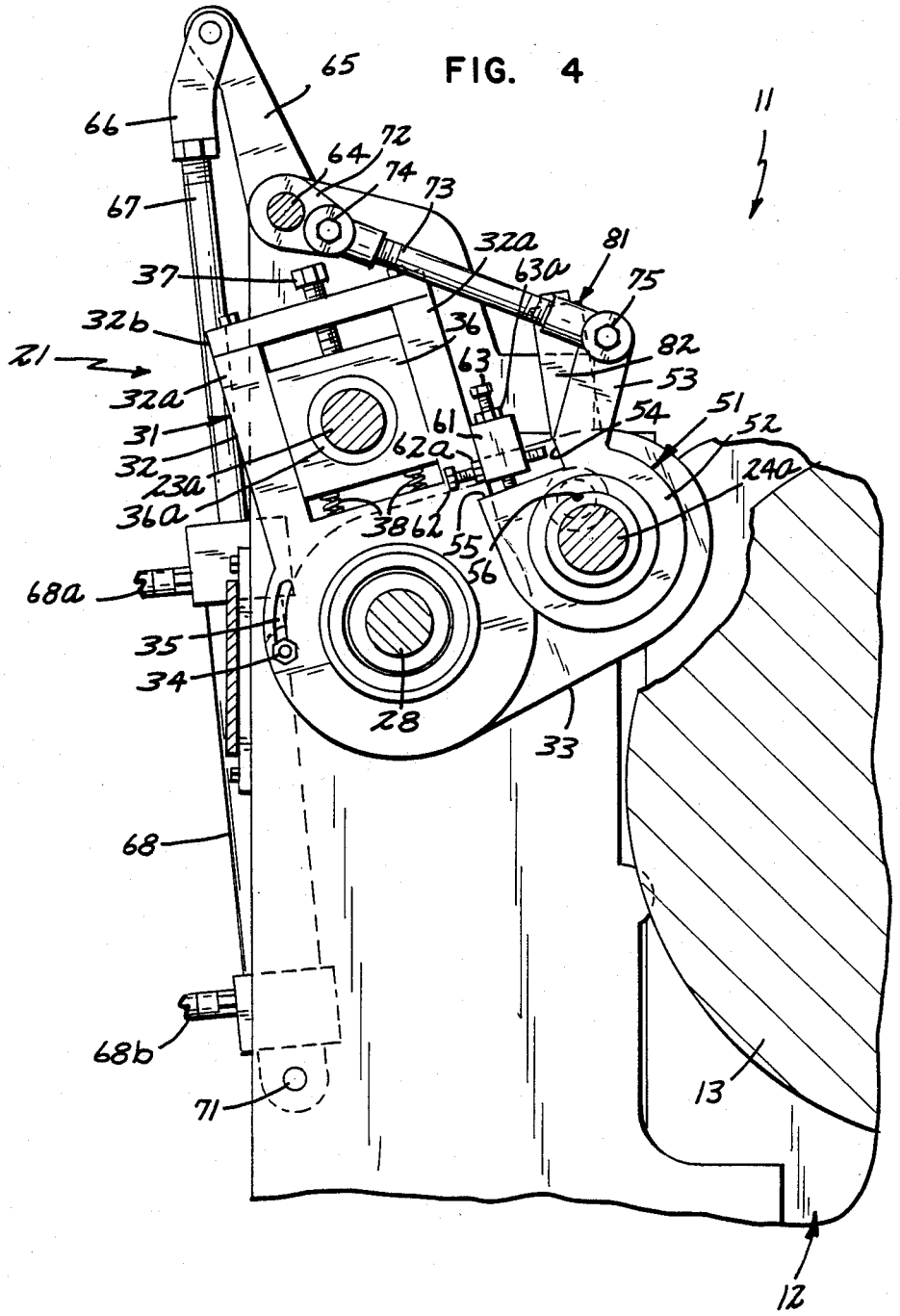
FIG. 4 is an enlarged fragmentary sectional view taken along the line 4—4 of FIG. 1 with the apparatus in the first mode of operation.

With specific reference to FIGS. 2–4, apparatus for providing a dampening fluid to the lithographic plate is represented generally by the numeral 21. Dampening apparatus 21 comprises a fluid supply or transfer roller 22 the function of which is to receive dampening fluid from a fluid source and to transfer it in metered quantities, a metering roller 23 the function of which is to meter the amount of dampening fluid on supply roller 22, a form roller 24 the function of which is to transfer dampening fluid to the surface of the plate cylinder 13, and a bridge roller 25 the purpose of which is to transfer ink from the ink roller 15 to the form roller 24.

With reference to FIGS. 1 and 2, fluid supply roller 22 is rotatably mounted about a fixed axis within the frame 12. As such, the position of supply roller 22 within the frame 12 is stationary, although it is capable of rotation. Supply roller 22 is driven by a variable speed motor 20 through a gear reduction box 26, coupling 27 and drive shaft 28 at a desired rotational speed.

Fluid supply roller 22 is generally of the type disclosed in U.S. Pat. No. 3,168,037, which issued to Harold P. Dahlgren on Feb. 2, 1965; viz., it is a metallic roller having a smoothly polished surface and is chemically treated so that it is hydrophilic (has an affinity to water).

Figure 6:
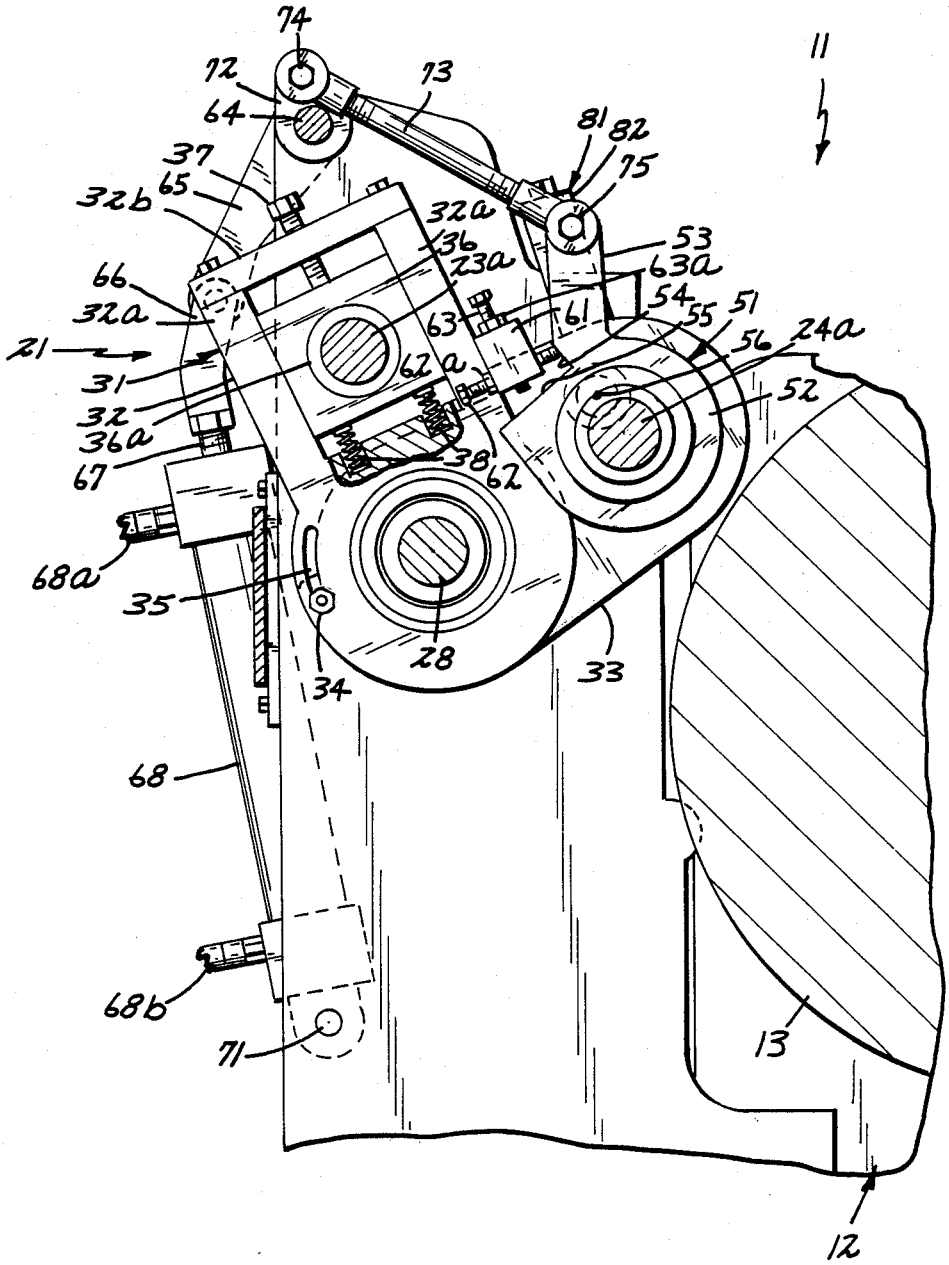
FIG. 6 is a view similar to FIG. 4 with the apparatus in a second mode of operation.

With reference to FIGS. 2 and 6, metering roller 23 is rotatably mounted in a main hanger frame bearing the general reference numeral 31. Main hanger frame 31 comprises an upright section 32 and a generally horizontal section 33, the sections 32, 33 being relatively slidable about the drive shaft 28 and secured in a fixed relative position by a nut and bolt 34 disposed in an arcuate slot 35.

The upright section 32 of main hanger frame 31 has spaced legs **32*a* that slidably receive a rectangular bearing block 36 therebetween. The bearing block 36 has a bearing 36*a* in which one end of the shaft 23*a* of metering roller 23** is carried.

A bridge member **32*b* interconnects the legs 32*a* and carries an adjustment bolt 37 that projects through and acts as an upper limit stop to the bearing block 36. The bearing block 36 is urged upwardly into engagement with the adjustment bolt 37 by a pair of springs 38 disposed in recesses formed in the hanger section 32**.

A main hanger frame **31*a* which is symmetrically identical to the hanger frame 31 is disposed at the opposite side of printing press 11 to support the other end of the metering roller 23, as well as form roller 24. However, of the two hanger frames 31, 31*a*, only frame 31 includes the arcuate slot 35 and nut and bolt assembly 34 and portions 32, 33 of frame 31*a* are of onepiece construction. This permits the relative position of the hanger sections 32, 33 to be adjusted, and accordingly, to skew one end of the metering roller 23 to insure a proper rotational relationship between the rollers 22, 23**.

It will be here noted that in the interest of brevity only those components associated with frame 31 on the left side of FIG. 1 will hereinafter be described and that similar components associated with frame **31*a* on the right side of FIG. 1 for mounting the other end of rollers 23, 24** will carry similar reference numerals where possible.

With specific reference to FIG. 2, a gear 29 is mounted on the drive shaft 28 of hydrophilic roller 22. A slightly smaller gear 39 is mounted on the shaft **23*a* of metering roller 23, and the two gears 29, 39 meshably engage so that the metering roller 23 is rotated at a slightly faster rotational speed than hydrophilic roller 22. However, and as best shown in FIG. 3, the outer cylindrical surfaces of both the rollers 22, 23 engage, and there is a slight wiping action between these surfaces as the metering roller 23** rotates slightly faster.

In the preferred embodiment, the outer surface of metering roller 23 is formed from a layer of rubber or an alternate resilient material suitable for the intended purpose.

Figure 5:
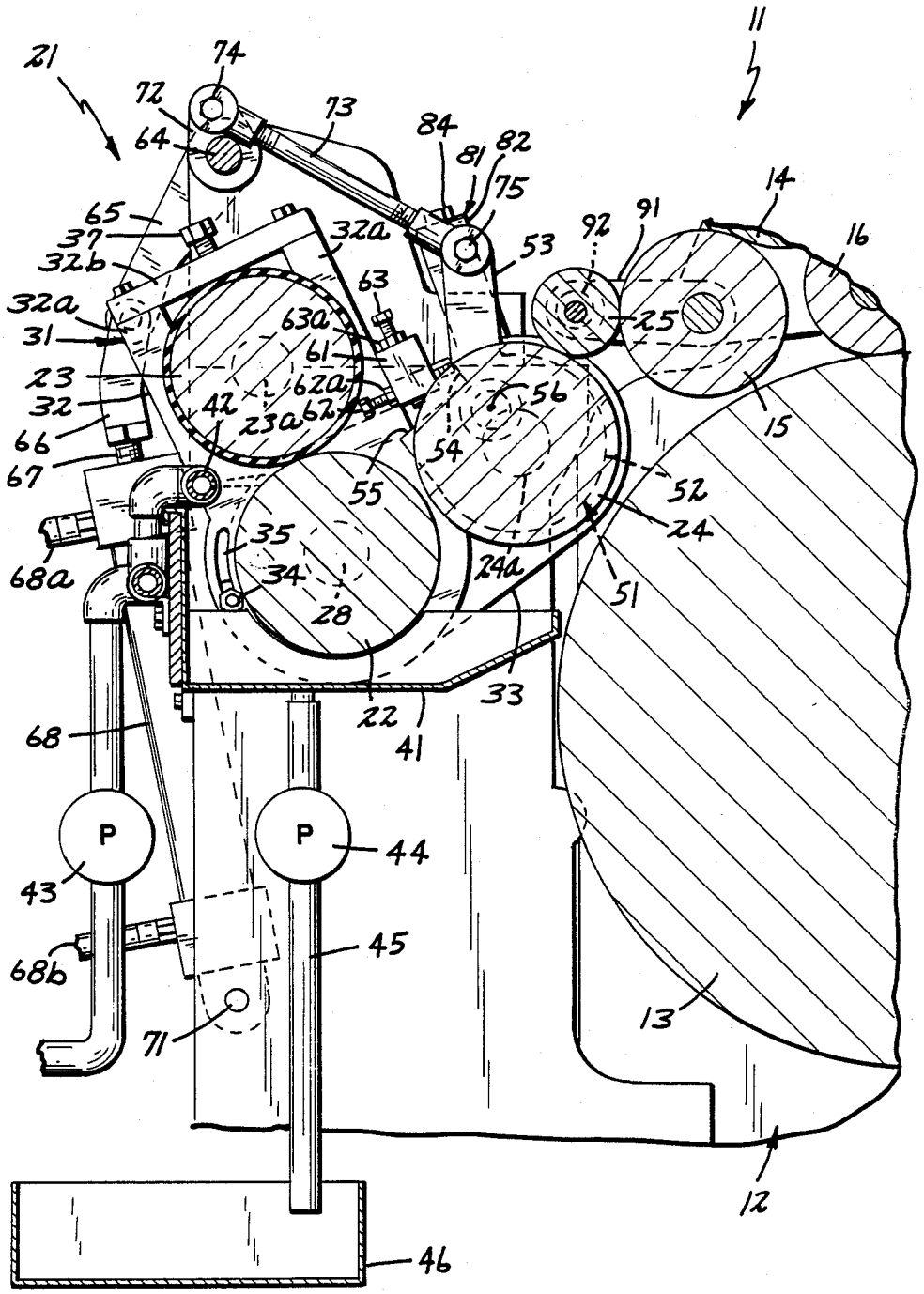
FIG. 5 is a view similar to FIG. 3 with the apparatus in a second mode of operation.

With reference to FIGS. 1 and 5, a longitudinal drip pan 41 is carried by the frame 12 below the hydrophilic roller 23 over its entire length. A dampening fluid, which is preferably water, is applied to the nip between hydrophilic roller 22 and metering roller 23 by a plurality of water jets emanating from a water supply pipe 42 having a plurality of apertures sized and spaced in a desired manner. A pump 43 pumps water into the supply pipe 42 at a desired pressure, and a pump 44 in a drain pipe 45 assists in positively draining water from the drip pan 41 into a waste reservoir 46. It is imperative that the water supplied to hydrophilic roller 22 be clean for optimum printing results, and the water is recycled through a filter (not shown).

With reference to FIG. 4, a form roller hanger for rotatably carrying the form roller 24 is represented generally by the numeral 51. Form roller hanger 51 is of irregular shape, including a somewhat circular body 52 from which an arm member 53 upwardly projects. Planar abutment surfaces 54, 55 are machined into the body 52 at a right angle.

Roller hanger 51 is pivotally mounted to the horizontal section 33 of main hanger frame 31 for free pivotal movement about a pivot axis 56. Form roller 24 has a rotatable shaft 24*a* mounted in a suitable bearing 57 in the roller hanger body 52. It should be noted that the rotational axis of the roller shaft 24*a* is spaced from the pivot axis 56, and as such, pivotal movement of the form roller hanger 51 causes the form roller 24 to move eccentrically relative to the pivot axis 56.

With continued reference to FIG. 4, a limit stop block 61, is mounted to the upright section 32 of main hanger frame 31. Block 61 carries adjustable limit stop screws 62, 63, which are respectively engageable with the planar abutment surfaces 54, 55. Lock nuts 62*a*, 63*a* serve to respectively lock the limit stop screws 62, 63 in desired limit stop positions. The two operational positions of form roller hanger 51, as determined by stop screws 62, 63, are shown in FIGS. 4 and 6.

The function of limit screw 62 is to prevent counterclockwise rotation of hanger 51 beyond a predetermined limit which defines the inoperational position of form roller 24. Limit stop screw 63 determines the extent to which form roller hanger 51 may move in a clockwise direction, and hence determines the specific point at which form roller 24 engages hydrophilic roller 22, as described in further detail below.

With reference to FIGS. 3–6, a horizontal pivot shaft 64 is carried between opposite sides of the frame 12. A long lever arm 65 is secured to the pivot shaft 64 for rotation therewith externally of the frame 12. A pivot link 66 connects the lever arm 65 with the extensible rod 67 of a pneumatic actuator 68. Actuator 68 is pivotally connected to the frame 12 as shown at 71 and includes air supply and exhaust lines 68*a*, 68*b*.

A short lever arm 72 is secured to the pivot shaft 64 for rotation therewith, such rotation being substantially coplanar with the limited rotational movement of the form roller hanger 51. A tie rod 73, the length of which is adjustable by threaded end couplings, has one end pivotally connected to the short lever arm 72 by a pivot bolt 74. The opposite end of the tie rod 73 is pivotally connected to the arm member 53 of form roller hanger 51 by a pivot bolt 75.

Short lever arm 72 is angularly positioned on the pivot shaft 64 in a manner so that the tie rod 73 moves through an over center position as the pneumatic actuator 68 moves from a retracted position (FIG. 5) to an extended position (FIG. 3). In the fully extended position of FIG. 3, the tie rod 73 has moved just slightly over center relative to the pivotal connection between the tie rod 73 and hanger arm member 53, and these respective components are therefore locked in the position of FIG. 3 even though pressure fluctuations in the air supply to pneumatic actuator 68 may occur.

With the respective components constructed and arranged as shown in the figures, retraction of the pneumatic actuator 68 causes the rollers 22, 23 and 24 to be in the position shown in FIG. 5. Hydrophilic roller 22 and metering roller 23 are in rotatable engagement (as they are in all positions of the apparatus), and dampening form roller 24 is in a position of nonengagement with both the plate cylinder 13 and the hydrophilic roller 22. As the pneumatic actuator 68 is extended, the lever arms 65, 72 and tie rod 73 are initially moved from one limit position (FIG. 5) to the other limit position (FIG. 3), at which time the form roller 24 engages the hydrophilic roller 22. The degree of engagement is precisely determined by the limit stop screw 63.

At the time that the planar abutment surface 55 engages the limit stop screw 63, the pneumatic actuator 68 is only partially extended. Further extension imparts counterclockwise rotational movement of the entire main hanger frame 31 about its pivot axis (the rotational axis of hydrophilic roller 22), and this movement causes the form roller 24 to engage the plate cylinder 13 due to the presence of a limit stop 81 described below.

With reference to FIG. 3, the metering roller 23 is in continuous engagement with the transfer roller 22 and defines a line of contact therewith (which appears as a point of contact in the sectional view of FIG. 3). With the form roller 24 in the position shown in FIG. 3, in which it engages both the plate cylinder 13 and the transfer roller 22, it also defines a line of contact with the transfer roller 22. Because of the relative proximity of the metering roller 23 and form roller 24, these two lines of contact are spaced apart on the fluid supply roller 22 a predetermined amount.

With reference to FIGS. 1–3, limit stop 81 specifically comprises an L-shaped member 82 the upright leg of which is secured to the side of main hanger frame 31 by a suitable fastener 83 (FIG. 1 only). With reference to FIG. 2, the horizontal arm of the member 82 carries a threaded bolt 84 having adjustable lock nuts 84*a*. A coil spring 85 extends between the end of bolt 84 and a recess in the frame 12.

With reference to FIG. 3, the horizontal arm of L-shaped member 82 carries an Allen screw 86 the lower end of which abuts the frame 12 with the pneumatic actuator 68 in its fully extended position. The Allen screw 86 may be adjusted to determine the precise engaging position of the form roller 24 on the plate cylinder 13, and a lock nut 86*a* secures the Allen screw 86 in the desired position.

With reference to FIGS. 2 and 3, bridge roller 25 is carried by a bridge roller hanger 91 at each end, the hanger 91 being pivotally carried for swinging movement about the rotational axis of ink roller 15. The hanger 91 carries an eccentric mount 92 having a set screw 93 permitting adjustment of the rotational axis of bridge roller 25 to insure that it uniformly engages the form roller 24 as well as the ink roller 15.

The bridge roller hanger 91 pivots freely about the axis of ink roller 15, permitting the bridge roller 25 to engageably follow the form roller 24 through its range of movement, while also maintaining proper contact with the ink roller 15. As such, bridge roller 25 is in continuous proper engagement with both the ink roller 15 and the form roller 24 notwithstanding extension and retraction of the pneumatic actuator 68.

The bridge roller 25 is oscillated longitudinally (i.e., it moves back and forth along its longitudinal axis of rotation) in a conventional manner by means not shown to better distribute ink on the form roller 24.

In operation, with the pneumatic actuator 68 retracted, the respective components are as shown in FIGS. 5 and 6. Water is continuously sprayed onto hydrophilic roller 22 by the water supply pipe 42, and metering roller 23 is in rotatable and wiping engagement with the hydrophilic roller 22 to uniformly control the thickness of the water layer or film on the surface of roller 22. In this position, the form roller 24 is out of engagement with hydrophilic roller 22, but remains in engagement with bridge roller 25. Ink roller 15 is not in contact with plate cylinder 13, as is the conventional practice. As such, the printing press 11 is inoperative.

With a lithographic plate (not shown) mounted on the plate cylinder 13, operation of the press 11 is initiated by causing the pneumatic actuator 68 to move to its extended position. In so doing, form roller 24 initially engages hydrophilic roller 22 as described above, with contact properly established by adjustment of the limit stop screw 63.

Prior to engagement with the hydrophilic roller 22, form roller 24 has been rotatably driven by its engagement with oscillating bridge roller 25, and as a result has a uniform layer of ink over its surface. Upon engagement with the hydrophilic roller 22, a layer or film of water is "milled" onto the form roller 24 by the hydrophilic roller 22, which rotates at a greater speed. Having received a layer of water from hydrophilic roller 22, the form roller 24 is now ready for engagement with the plate cylinder 13. Further extension of the pneumatic actuator 68 causes the form roller 24 to engage the plate cylinder 13 as described above, with precise contact determined by setting of the Allen screw 86. At this time, the form roller 24 immediately applies water to the lithographic plate on plate cylinder 13 in a precisely controller proper amount. This engagement is shown in FIGS. 1-4, which also show the ink roller in rolling engagement with the lithographic plate of plate cylinder 13.

When the pneumatic actuator 68 is retracted to the inoperative position, form roller 24 first leaves engagement with the plate cylinder 13, and thereafter leaves engagement with the h. drophilic roller 22.

As described, the dampening apparatus is capable of uniformly applying water to the lithographic plate in precisely controlled quantities, which produces optimum printing results, while at the same time avoiding undesirable intermixture of excessive quantities of ink and water, which results in emulsification and poorer printing results.

What is claimed is:

1. Apparatus for dampening a lithographic plate on a printing press plate cylinder, comprising:

frame means;

first hanger means mounted to the frame means for pivotal movement between first and second positions about a first pivot axis;

a fluid supply roller carried by the first hanger means for rotation about a first axis coinciding with said first pivot axis;

first drive means for driving the fluid supply roller at a selected rotational speed;

means for supplying dampening fluid to the fluid supply roller over substantially its entire length;

a metering roller carried by the first hanger means for rotation about a second axis in rotating engagement with the fluid supply roller;

second drive means for driving the metering roller at a rotational speed different than that of the fluid supply roller;

second hanger means mounted to the first hanger means for pivotal movement between first and second positions about a second pivot axis;

a dampening form roller carried by the second hanger means for rotation about a third axis spaced from said second pivot axis;

third drive means for driving the dampening form roller at a rotational speed different than that of the fluid supply roller;

the fluid supply and form rollers and said first and second hanger means being constructed and arranged so that the dampening form roller moves into rotational engagement with the fluid supply roller when the second hanger means is moved from its first position to its second position, and for moving the form roller into engagement with the plate cylinder when the first hanger means is moved from its first position to its second position;

and actuator means for sequentially moving the second hanger means from its first to its second position, and the first hanger means from its first position to its second position, whereby the dampening form roller first engages the fluid supply roller and then engages the printing press plate cylinder.

2. The apparatus defined by claim 1, which further comprises adjustable stop means for adjustably limiting movement of the first hanger means beyond its second position, whereby engagement of the form roller with the plate cylinder is precisely controlled.

3. The apparatus defined by claim 1 or 2, which further comprises adjustable stop means for adjustably limiting movement of the second hanger means beyond its second position, whereby engagement of the form roller with the fluid supply roller is precisely controlled.

4. The apparatus defined by claim 1, wherein the first drive means comprises variable speed motor means.

5. The apparatus defined by claim 1, wherein the means for supplying dampening fluid is constructed and arranged to spray dampening fluid on the fluid supply roller in a plurality of fluid jets.

6. The apparatus defined by claim 5, wherein the means for supplying dampening fluid comprises a pipe disposed adjacent to and in substantial parallel relationship to the fluid supply roller, the pipe having a plurality of spaced apertures facing the fluid supply roller, and being adapted for connection to a source of dampening fluid under pressure.

7. The apparatus defined by claim 1, wherein the dampening fluid is water.

8. The apparatus defined by claim 1, wherein the external surface of the fluid supply roller is hydrophilic.

9. The apparatus defined by claim 1 or 8, wherein the external surfaces of the form and metering rollers are resilient.

10. The apparatus defined by claim 1, wherein the second drive means comprises first and second intermeshing gears respectively mounted on the fluid supply and metering rollers.

11. The apparatus defined by claim 1, wherein the second drive means is constructed and arranged to drive the metering roller at a rotational speed greater than that of the fluid supply roller.

12. The apparatus defined by claim 1, which further comprises means for adjustably skewing one of said fluid supply and metering rollers relative to the other.

13. The apparatus defined by claim 1, which further comprises means for uniformly applying ink to the form roller.

14. The apparatus defined by claim 13, wherein the ink applying means comprises an ink transfer roller mounted for rotation about a fourth axis and disposed in rolling engagement with the form roller.

15. The apparatus defined by claim 14, which further comprises third hanger means for mounting the transfer roller.

16. The apparatus defined by claim 15, which further comprises an ink roller mounted for rotation about a fifth axis and disposed in engagement with the transfer roller, said third hanger means being mounted for pivotal movement about a third pivot axis that coincides with said fifth axis.

17. The apparatus defined by claim 16, wherein the third hanger means comprises adjustable eccentric bearing means for adjusting the rotational axis of the ink transfer roller relative to said fifth axis.

18. The apparatus defined by claim 14, wherein the third drive means comprises said ink transfer roller.

19. The apparatus defined by claim 1, wherein the third drive means comprises said plate cylinder.

20. The apparatus defined by claim 1, wherein the third drive means is constructed and arranged to rotate the form roller at a rotational speed less than that of the fluid supply roller.

21. The apparatus defined by claim 1, wherein the actuator means comprises toggle means for locking the first and second hanger means in said respective second positions.

22. The apparatus defined by claim 21, wherein the actuator means comprises:

a fluid cylinder movable between extended and retracted positions;

lever means operatively connected to the fluid cylinder;

tie rod means pivotally connected between said lever means and said second hanger means;

said lever means and said second hanger means being constructed and arranged so that the tie rod means moves to an over center position when the second hanger means is moved from the first position to the second position.

* * * * *